United States Patent [19]

Haberle

[11] 4,216,553

[45] Aug. 12, 1980

[54] TOILET WITH FOLDING LID

[76] Inventor: Walter Haberle, Gronauer Weg 16, D-6368 Bad Vilbel, Fed. Rep. of Germany

[21] Appl. No.: 905,355

[22] Filed: May 12, 1978

[30] Foreign Application Priority Data

May 12, 1977 [DE] Fed. Rep. of Germany ..... 2721433

[51] Int. Cl.[3] ..... E03D 9/00

[52] U.S. Cl. ..... 4/300; 4/223; 4/233

[58] Field of Search ..... 4/300, 233, 230, 223, 4/222

[56] References Cited

U.S. PATENT DOCUMENTS

| | | | |
|---|---|---|---|
| 1,346,311 | 7/1920 | Friedrich | 4/233 |
| 1,706,409 | 3/1929 | Osborne et al. | 4/233 |
| 2,605,478 | 8/1952 | Lassiter | 4/233 |
| 3,837,018 | 9/1974 | Haberle | 4/222 |

*Primary Examiner*—Lenard A. Footland

*Attorney, Agent, or Firm*—Becker & Becker, Inc.

[57] ABSTRACT

A toilet provided with a flushing device for flushing the toilet bowl, which is equipped with a spraying device at the bottom side of the toilet lid for spray-flushing the toilet bowl after the bowl has been flushed by its normal flushing device. The spraying device has its outlets in a rotatable section preferably rotatable by recoil action exerted by the spray water. A valve is associated with the supply of spray water for turning off the supply of spray water in response to the toilet lid being lifted off the toilet seat. The spraying device has associated therewith a timed valve system which limits each spraying cycle to a set time.

13 Claims, 6 Drawing Figures

TOILET WITH FOLDING LID

The present invention relates to a toilet with a foldable lid. With heretofore known toilets of this type, the flushing is not sufficient in order hygienically properly to post-clean the interior of the bowl. A proper hygiene of the bowl is assured only if after each use a cleaning is carried out by means of a hand brush. In public restrooms or toilets of restaurants and hotels, such post-cleaning is in most instances not carried out.

It is, therefore, an object of the present invention to provide a toilet which will overcome the above mentioned drawback.

This object and other objects and advantages of the present invention will appear more clearly from the following specification in connection with the accompanying drawings, in which FIG. 1 represents a longitudinal section through a toilet with a spraying device provided on the foldable lid.

The toilet according to the invention provided with a foldable lid is characterized primarily in that the bottom side of the lid is provided with a spraying device by means of which the interior of the toilet bowl can be spray-rinsed and after the completion of the flushing operation is simultaneously or subsequently disinfected.

Preferably, the spraying device is rotatably arranged at the bottom side of the foldable lid and during the spraying operation carries out a rotary movement. The outlet openings of the spraying device may in this connection be so arranged that the spraying device is actuated to rotate by the recoil of the out-flowing water.

A further feature of the present invention consists in that the spraying device is combined with a device arranged on the foldable lid and serving for cleaning the toilet seat. With such a design, it is advantageous to arrange the outlet openings of the spraying device on the circulating portion of the device for cleaning the toilet seat.

Furthermore, the design of the toilet is to be such that the supply of water to the spraying device and to the device for cleaning the toilet seat is shut off when the lid is folded up. When the lid is down, the water supply to the spraying device and to the device for cleaning the toilet seat is operated only over a limited period of time.

Figure 1:
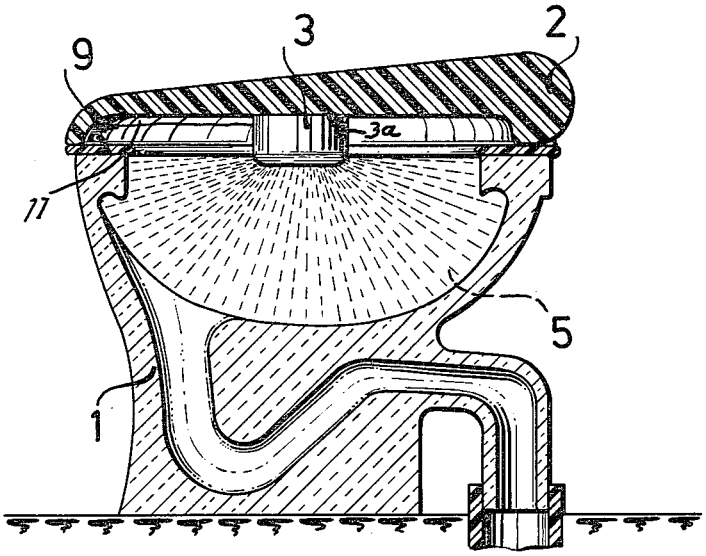
Figure 2:
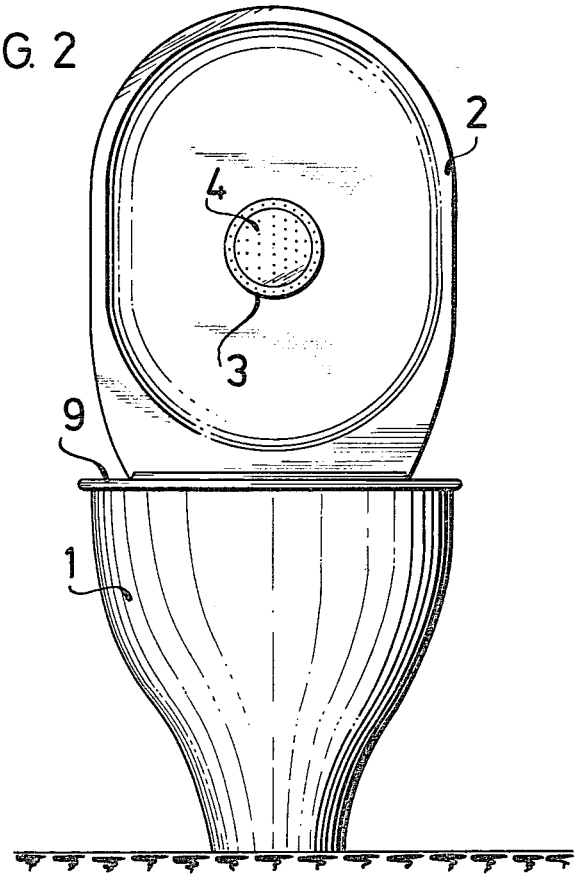
FIG. 2 shows a front view of the toilet bowl with folded-up lid.

Referring now to the drawings in detail, according to the embodiment shown in FIGS. 1 and 2, the toilet bowl 1 is provided with a foldable lid 2, the bottom side of which has arranged thereon a spraying device 3 for spray-rinsing the toilet bowl 1. The water required for spray-rinsing the toilet bowl 1 is conveyed to the spraying device 3 from the rear portion of the foldable lid 2. To this end, passage means 11 are provided in the foldable lid 2 which extend up to the spraying device 3. The spraying device 3 has the shape of a cap and is provided with outlet openings 4 which are so arranged that the out-flowing spray water 5 sprays over the entire surface of the toilet bowl 1. If desired, means may be provided for adding a disinfectant to the spray water 5, e.g. the spraying device 3 may be provided with a closable opening 3*a* through which a disinfectant may be introduced into device 3.

Figure 3:
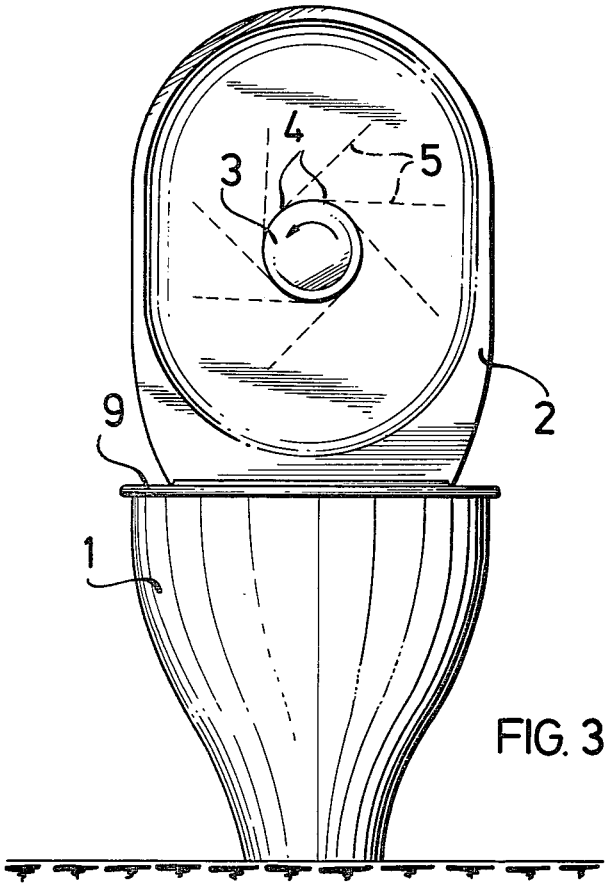
FIG. 3 represents a front view of a toilet bowl with folded-up lid and with a spraying device rotatably arranged on said foldable lid.
Figure 4:
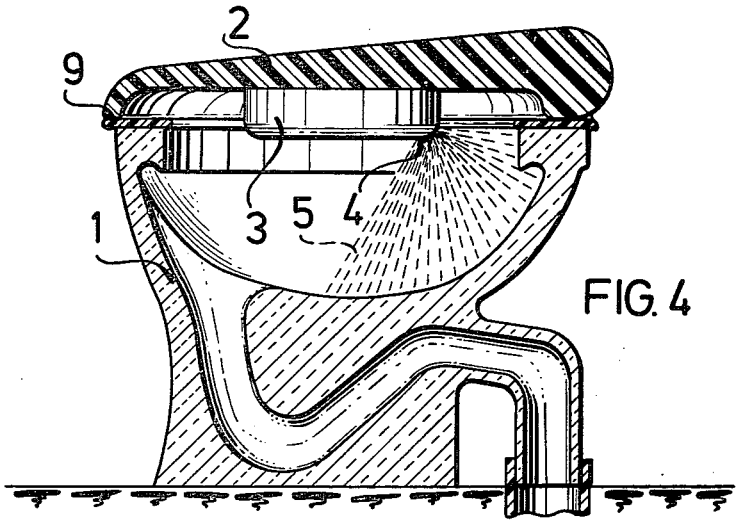
FIG. 4 is a longitudinal section through the toilet bowl with folded-down lid.

FIGS. 3 and 4 illustrate an embodiment in which the spraying device 3 is rotatably connected to the bottom side of the lid 2. The outlet openings 4 are in this instance so arranged that the spraying device 3 is subjected to rotation by the recoil of the out-flowing spray water 5. The outlet openings 4 for the spray water 5 are arranged in one or more rows at the outer circumference of the spraying device 3.

Figure 5:
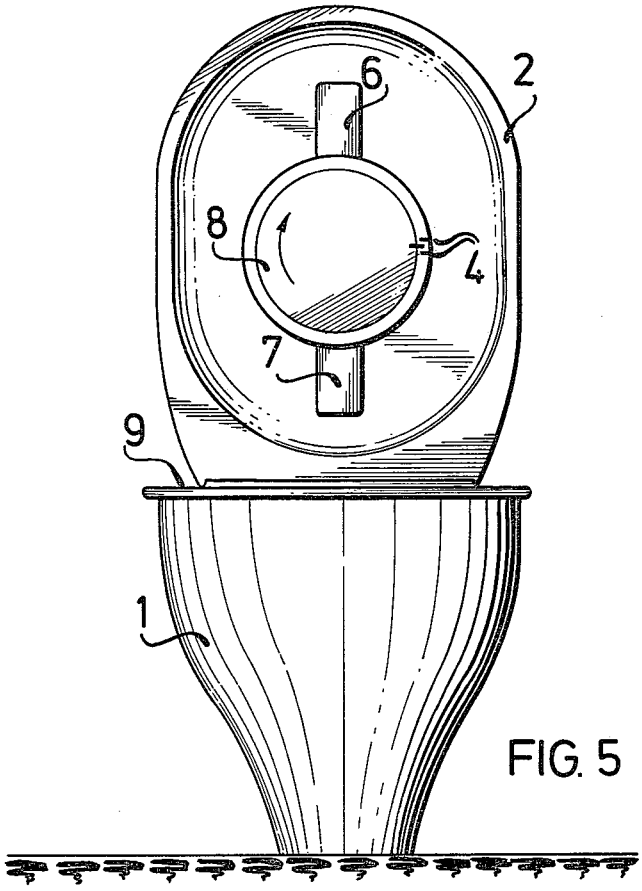
FIG. 5 is a front view of a toilet bowl with folded-up lid which latter is provided with a spraying device for spray-rinsing the toilet bowl and is also provided with a device for cleaning the toilet seat.
Figure 6:
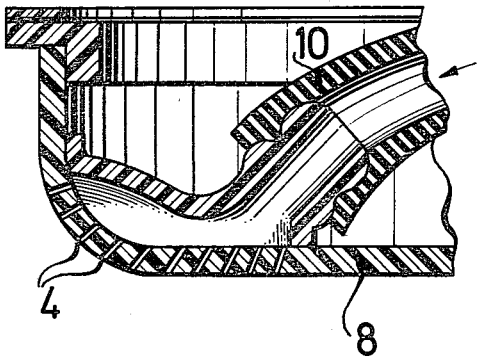
FIG. 6 represents a section through the exit openings of the spraying device for cleaning the toilet seat.

As will be seen from FIGS. 5 and 6, the spraying device 3 may also be combined with a device arranged on the lid 2 for cleaning the toilet seat 9. The outlet openings 4 of the spray water 5 are according to this embodiment arranged on the part 8 of the device which rotates together with the wipers 6 and 7 which part 8 is intended for cleaning the toilet seat 9. In this connection, the spray water 5 is by means of a covered-up hose 10 conveyed to the outlet openings 4.

The operation of the device is as follows: after the toilet has been used, first the flushing device is actuated. After the toilet bowl 1 has been flushed out and the lid 2 is in its folded-down position, the interior of the bowl 1 can be sprayed out and disinfected.

If the spraying device 3 is combined with a device arranged on lid 2 for cleaning the toilet seat 9, during the spraying operation, also the toilet seat 9 can be cleaned and disinfected. The cleaning operation is initiated by mechanically or electrically controlled devices which can be actuated manually or automatically by control elements arranged in the joint of lid 2. The duration of the spraying of the toilet bowl 1 and of the cleaning of the toilet seat 9 is limited timewise by corresponding control elements. When the lid 2 is folded up, the cleaning operation cannot take place because in this position, the control elements arranged at the joint of the lid 2 prevent the supply of the water required for spray-rinsing and cleaning, and the electric circuits for the operating devices are interrupted.

The advantages obtainable by the invention consist primarily in that the toilet bowl as well as the toilet seat can be cleaned and disinfected automatically prior to and after use of the toilet. The user of the toilet therefore has at his disposal a clean and hygienically proper toilet.

It is, of course, to be understood that the present invention is by no means limited to the specific showing in the drawings, but also comprises any modifications of the appended claims.

What is claimed is:

1. A toilet comprising a bowl, a toilet seat, a flushing device for flushing said bowl, and a foldable lid linked to said seat, which includes: a spraying device connected to the bottom side of said lid for spray-flushing the interior of said bowl after the latter has been flushed by said flushing device, and conduit means connected to said spraying device for conveying spray water thereto, cleaning means arranged on said lid and associated with a cleaning device for cleaning said toilet seat, the spraying device including a rotatable section provided with outlets for cleaning said toilet bowl.

2. A toilet according to claim 1, in which the spraying device is combined with a device for cleaning said toilet seat arranged on said lid.

3. A toilet according to claim 2, in which the outlets for the spraying device are arranged on the rotatable section of the device for cleaning the toilet seat.

4. A toilet comprising a bowl, a toilet seat, a flushing device for flushing said bowl, and a foldable lid linked to said seat, which includes: a spraying device connected to the bottom side of said lid for spray-flushing the interior of said bowl after the latter has been flushed by said flushing device, and conduit means connected to said spraying device for conveying spray water thereto, cleaning means arranged on said lid and associated with said cleaning device for cleaning said toilet seat, the spraying device including a rotatable section provided with outlets for cleaning said toilet seat.

5. A toilet according to claim 4, which includes means for adding a disinfectant to the spray water sprayed by said spraying device.

6. A toilet according to claim 4, in which said spraying device is rotatable during the spraying action thereof.

7. A toilet according to claim 6, in which said spraying device is rotatable by the recoil action of the spray water.

8. A toilet according to claim 4, which includes valve means associated with said conduit means and responsive to said lid occupying its folded-up position for interrupting the supply of spray water to said spraying device.

9. A toilet according to claim 4, which includes timing valve means associated with said spraying device for limiting the spraying time to a set period of time.

10. In combination with a water-flushing toilet, including a toilet bowl with an interior and provided with a foldable lid having an underside of the lid provided with the device there being effected spraying-off of the toilet seat by cleaning and disinfecting fluid as well as brush or wiper means cleaning the toilet seat and subsequently drying of the toilet seat being accomplished, the improvement therewith which comprises a spraying means provided with a device for automatic cleansing of the toilet seat, said spraying means being effective for spraying out and disinfecting the interior of the toilet bowl.

11. A water-flushing toilet in combination according to claim 10 in which said spraying means and said device for automatic cleansing of the toilet seat form a structural unit.

12. A water-flushing toilet in combination according to claim 11 in which a rotating part of the device for automatic cleansing of the toilet seat includes discharge openings for spray water.

13. A toilet having a toilet body including a bowl, a flushing device for said bowl, a seat and a lid pivotally connected to said toilet vody and foldable selectively toward and away from said seat, a device including a rotatable section for automatically cleaning the toilet seat, which includes in combination: a cleaning unit collectively comprising spraying means for dispersing cleaning and disinfecting fluid and also comprising means for wiping thereof and collectively being foldable toward and away from said bowl, said cleaning unit being mounted on said lid forming a structured unit with the seat collectively to be assembled with said toilet body and being adapted to receive cleaning fluid and disinfectant to spray the same onto the toilet seat, means operatively connected to said means for wiping and operable to cause means for wiping to clean said seat; and a spraying device provided with a plurality of outlets which are adapted for flushing the inner portion of the bowl with a cleaning and disinfection fluid, said spraying device and said cleaning device forming a structured unit and the said outlets being arranged on the rotatable section of the device for cleaning the toilet seat.

* * * * *